United States Patent [19]

Witz et al.

[11] Patent Number: 4,753,546

[45] Date of Patent: Jun. 28, 1988

[54] PRESSURE BALANCED STYLOGRAPHIC PEN

[75] Inventors: Wolfgang Witz, Easton; Fortunato J. Micale, Bethlehem; John P. Leuenberger, Bethlehem, all of Pa.

[73] Assignee: Koh-I-Noor Rapidograph, Inc., Bloomsbury, N.J.

[21] Appl. No.: 286,430

[22] Filed: Jul. 24, 1981

Related U.S. Application Data

[63] Continuation of Ser. No. 79,912, Sep. 28, 1979, abandoned, which is a continuation-in-part of Ser. No. 877,638, Feb. 14, 1978, abandoned.

[51] Int. Cl.[4] ..... B43K 5/18

[52] U.S. Cl. ..... 401/258; 401/225; 401/242

[58] Field of Search ..... 401/258–260, 401/225–229, 261, 263, 265, 242

[56] References Cited

U.S. PATENT DOCUMENTS

| | | | |
|---|---|---|---|
| 634,308 | 10/1899 | De Marest . | |
| 1,524,068 | 1/1925 | Wallace . | |
| 2,401,167 | 5/1946 | Kovacs | 401/259 |
| 2,891,512 | 6/1959 | Kovacs . | |
| 3,315,644 | 4/1967 | Riepe . | |
| 3,418,058 | 12/1968 | Gossel . | |
| 3,442,597 | 5/1969 | Hebborn et al. | 401/259 |
| 3,459,486 | 8/1969 | Matschkal . | |
| 3,539,269 | 11/1970 | Dahle . | |
| 3,741,668 | 6/1973 | Danjzcek et al. | 401/258 |
| 3,756,733 | 9/1973 | Glasa et al. . | |
| 3,788,754 | 1/1974 | Glasa et al. . | |
| 3,824,023 | 7/1974 | Danjczek et al. | 401/258 |
| 3,870,421 | 3/1975 | Mutschler . | |
| 4,207,012 | 6/1980 | Kuparinen | 401/258 |

FOREIGN PATENT DOCUMENTS

| | | | |
|---|---|---|---|
| 1259733 | 1/1968 | Fed. Rep. of Germany . | |
| 1273368 | 7/1968 | Fed. Rep. of Germany . | |
| 1561871 | 4/1970 | Fed. Rep. of Germany | 401/259 |
| 1911950 | 9/1970 | Fed. Rep. of Germany | 401/259 |
| 1906013 | 9/1970 | Fed. Rep. of Germany . | |
| 1911951 | 9/1970 | Fed. Rep. of Germany . | |
| 2019917 | 11/1971 | Fed. Rep. of Germany . | |
| 1786443 | 3/1972 | Fed. Rep. of Germany . | |
| 2136155 | 1/1973 | Fed. Rep. of Germany | 401/258 |
| 2216015 | 10/1973 | Fed. Rep. of Germany . | |
| 2460345 | 7/1975 | Fed. Rep. of Germany | 401/258 |
| 986766 | 8/1951 | France . | |
| 135599 | 5/1979 | German Democratic Rep. | 401/258 |
| 1192124 | 5/1970 | United Kingdom | 401/258 |
| 1192123 | 5/1970 | United Kingdom . | |

*Primary Examiner*—Steven A. Bratlie

*Attorney, Agent, or Firm*—David H. Semmes; Warren E. Olsen

[57] ABSTRACT

Improvements in stylographic technical writing pens, particularly through a venting channel design which provides for a pressure balancing, or equalization, between an ultimate ink reservoir pressure and the total pressure at the writing tip; as writing depletes ink within the reservoir. Particularly, a venting channel, extending from the reservoir to ambient air, has the size of its cross-sectional shape vary as a function of the distance from its communication with the reservoir, with the variation calculated to offset gravitational forces attendant to a moving ink meniscus inside the vent channel. The balancing of total pressures also provides a constant ink flow through the writing tip when writing since the total pressure at the tip is maintained constant by the vent channel configuration.

The present invention is characterized by the novel approach, of beginning with the insight that a varying static pressure, from a varying level of ink to a vent channel, must exactly offset by the capillary forces at the meniscus of that ink level in the vent channel, and then creating a total vent structure that can follow that relationship.

8 Claims, 5 Drawing Sheets

PRESSURE BALANCED STYLOGRAPHIC PEN

This is a continuation of application Ser. No. 079,912 filed Sept. 28, 1979, now abandoned, which is a continuation-in-part of Ser. No. 877,638 filed Feb. 14, 1978 now abandoned.

BACKGROUND OF THE INVENTION

1. Field of the Invention

Stylographic or technical writing pens of the general type embodying an ink reservoir, and a tubular stylus or writing tip which is communicated to the reservoir, wherein a weighted cleaning wire is positioned within the reservoir for reciprocal cleaning movement within the writing tip. The improvements taught herein specifically relate to a new manner of designing venting channels for such a category of device, so that the pen point will not drip, in response to ever present ink contractions, and expansions, into the venting channel.

2. Description of the Prior Art

At the present time applicants are aware of numerous prior art teachings with respect to the design of a venting channel, i.e., expansion chamber, within an overall technical drafting pen design. An appreciation for the numerous, and disparate, prior art approaches to technical pen designs may be had by reference to the following Patent Nos.:

| | |
|---|---|
| Federal Republic of Germany: | |
| Brossi | AUS 1,259,733 (1968) |
| Faber-Castell | AUS 1,273,368 (1968) |
| Kupferschmidt | OFF 1,561,871 (1970) |
| Riepe | AUS 1,786,443 (1972) |
| Riepe-Werke | AUS 1,906,013 (1970) |
| Riepe | OFF 1,911,950 (1970) |
| Riepe et al | OFF 1,911,951 (1970) |
| Gunter | OFF 2,019,917 (1971) |
| Riepe | OFF 2,136,155 (1973) |
| Riepe | OFF 2,216,015 (1973) |
| Arrasse | OFF 2,460,345 (1975) |
| France: | |
| Clement | 986,766 (1951) |
| Great Britain: | |
| Riepe | 1,192,123 (1970) |
| Riepe | 1,192,124 (1970) |
| United States: | |
| DeMarest | 634,308 |
| Wallace | 1,524,068 |
| Kovacs | 2,401,167 |
| Kovacs | 2,891,512 |
| Riepe | 3,315,644 |
| Gossel | 3,418,058 |
| Hebborn et al | 3,442,597 |
| Matschkal | 3,459,486 |
| Dahle | 3,539,269 |
| Danjzcek et al | 3,741,668 |
| Glasa et al | 3,756,733 |
| Glasa et al | 3,788,754 |
| Danjczek et al | 3,824,023 |
| Mutschler | 3,870,421 |

The large number of above-listed prior art teachings is a testimony to the lack of agreement, among technical pen designers, with respect to a overall pen design which will be serviceable in a drafting environment. This is a most crowded art, and a large number of the above-noted patents are owned by an affiliate of the assignee of the present application. While each of the above-identified prior art references is analogous art to the invention taught herein, none of the prior teachings, individually or collectively, is seen to be pertinent to the present teachings for a manner of pressure balancing a stylographic pen, through a parametrizing of certain critical geometrical relationships within the drafting pen itself. As has been noted hereinbefore, the prior art was completely ignorant of the approach taught herein, and the present invention is predicated upon the essential and inventive beginning of looking at the total pressure, at a pen point, with respect to the entire ink volume, including capillary effects. Applicants identified the problem of drip to be one which was inherent whenever a volume of ink were to be displaced, due to air expansion, and consequent movement into an expansion chamber, i.e., a venting channel. Applicants' novel approach was to create a structure which would inherently maintain a total pressure balance, so the pen tip would not drip, despite ink expansions and contractions. It was applicants who first identified the essential problem of pen dripping and related performance parameters to be located primarily in the venting channel, and thereafter the inventors invented a constant total pressure system, at the writing tip, by an exact design parametrization for the total pen, and particularly the venting channel. It is also only applicants who teach how to use the LaPlace equation in a manner which allows analytical designing of a pen, and a design which has been proven empirically.

A number of the above-noted prior art discusses that the cross-section of the venting channel could be changed, and in some cases increased, maintained as large as possible, or otherwise. For example Riepe AUS Pat. No. 1,786,443 (equivalent to Great Britain Pat. No. 1,192,124) is owned by a foreign affiliate of the present assignee, and was well-known to the inventors herein. Riepe AUS Pat. No. 1,786,443 specifically illustrates a double spiral channel (4, 4') with an interconnection channel (A), all for the clearly taught purpose of preventing loss of moisture from the ink, and to somewhat prevent ink loss upon shaking. Hence, Riepe AUS Pat. No. 1,786,443 represents a 1972 level of thinking that an ink equilization chamber must be as large as possible, and there is hardly any suggestion, let alone specific teaching, that a cross-sectional shape should be exactly varied as a function of its height above the point of interconnection of that venting channel to an ink reservoir. In striking contrast, the present invention offsets the increases in hydrostatic vented ink column pressures by exactly balancing this increase through a capillary pressure increase at the ink/air interface of that section within the venting channel, through a design criteria based upon the LaPlace equation.

Similarly, Riepe AUS Pat. No. 1,906,013 is not particularly concerned with any design constraints for a given helical shaped channel, rather, this patent focuses upon simply giving a given pitch to the vent channel, to compensate for the female screw threads which surround.

The U.S. patent in the name of Gossel, U.S. Pat. No. 3,418,058, is considered analogous to the present invention, insofar as he teaches, at column 2, lines 50+, that his vent channel, B, is "designed so that its cross-sectional area of flow gradually increases from its rear end toward its front end," and also since Gossel illustrates one form of insert that can be discarded and replaced with another, if cleaning is not to be done. As will become more apparent hereinbefore, Gossel's approach is entirely without appreciation that the *value* of any cross-section can control ink flow at the point. Gossel's stated purpose is merely to allow an easy removal of the insert, and his passage (e) is located far from the point, not close, as is preferably taught herein.

Kovacs, U.S. Pat. No. 2,401,167, illustrates a vent system having two interior helical ribs (5, 5'), which form helical venting channels, whrrein the lower end of the channel communicates with atmosphere and, again, an upper end vent hole into the ink supply. In this respect it is similar to the Gossel technique, and Kovacs' non-enabling teachings on the venting channel is simply that the venting channels "increase in depth from their inner ends to their outward ends."

Accordingly, it can be seen that there is no shortage of helical venting channel teachings in the prior art, and further reference may be had, for example, to the Dahle U.S. Pat. No. 3,539,269, or the German Pat. Nos. Riepe OFF 1,911,950 and Riepe-Werke OFF 2,136,155.

The preferred embodiment of the present invention, as taught hereinafter, employs a helical spiral technique for exactly varying a cross-sectional shape of a venting channel, as a function of its height above a particular, and low, point of communication into an ink reservoir. Nonetheless, the present invention does not require that the vent channel move in a helical fashion, only that its cross-sectional area be a direct function of that sectional height above the communication between the channel and the reservoir. Accordingly, the prior art patents above-discussed are, by contrast, a testimony to the unique departure of the present invention. For example, Kovacs U.S. Pat. No. 2,401,167 at FIG. 1, illustrates an ink reservoir, 4, and a venting channel, 6, which communicates to the *upper* end of the reservoir, through passage 7. It was characteristic, in the prior art, to always locate the vent hole at the top of the pen nib or ink reservoir, while the present invention teaches advantages to a *minimized* value for $L_2$.

To summarize, the foregoing listed patents, suggest various and sundry ways of designing a vent channel, including varying the cross-sectional area of a given venting channel, according to all manner of thinking. However, and as will become more apparent hereinafter, none begin to suggest that a venting channel must be designed so that its cross-sectional area is varied as a direct function of the distance, of that cross-section, above the interconnection of the entire vent channel system and the ink reservoir which is being so vented. Moreover, the prior art includes no enabling disclosure as to how the LaPlace equation can be critically used to generate a design *parametrization,* so that any increase in gravitational pressures, as the result of an increasing column of ink in a vent channel, can be exactly offset by a vent channel which necessarily also exactly increases the capillary pressure upon the meniscus of that increasing ink column. Accordingly, and in complete distinction to the stated reasons for any given particular vent channel structure within the above-noted prior art teachings, applicants herein, first have taught, that a well behaved technical drafting pen can result if you structurally ensure that the total pressure at the writing tip remains a constant, despite variations in the level of an ink column within a venting channel. It is well known that atmospheric and temperature changes will constantly vary the level of ink in an expansion chamber, and only the present invention teaches that an exact total pressure balance of the pen tip is a possibility. More importantly, the applicants herein teach an exact manner of making a venting channel structure so as to ensure that total pressure balance.

SUMMARY OF THE INVENTION

According to the present invention, a venting channel for a technical writing pen is constructed such that both the vent hole, which communicates the ink reservoir to an expansion or venting system, and the outlet point of that venting system, which communicates ultimately to the ambient air, are adjacent to the writing tip of the pen. Secondly, the present invention critically teaches how to configure a venting channel cross-sectional shape as a direct function of the distance of that cross-sectional shape from the point of communication of the vent channel into the ink reservoir. The relationship was derived by applicant by employing a total balance circumstance which also takes into account capillary pressures, through developments upon the known LaPlace equation for any interface between a liquid and a gas. Thirdly, the present invention teaches certain specific embodiments, including a preferred double-spiral channel embodiment, which allows the venting channel to extend longitudinally away from the vent hole, and then, with a new reference point, extend toward the writing tip and, ultimately, to a point which communicates the entire vent system to ambient air pressure. In the preferred embodiment of the invention, the cross-section of the venting channel, as measured from the communication into the ink reservoir, gradually decreasing in cross-sectional area to a point of a cross-over to the ssecond spiral, wherein that cross-section then increases as the direction is reversed and as the vent cross-section ultimately communicates to the aperture near the tip, so that ambient air is taken proximate that at the tip.

The present teachings for the design of a capillary system are governed by a derived relationship of total pressure at the pen point, wherein capillary pressures of the ink fluid, in the venting channel, offset gravitational or hydrostatic pressures from the particular level of that ink column in the venting channel. Modifications and embodiments of the present invention include dimensioning the shape of the cross-section in round, square, or rectangular configurations, as well particular improvements wherein the venting channel itself is defined within a replaceable cartridge which itself may be disposed of, without requiring any cleaning in use. The preferred embodiment of the invention includes a semicircular configuration at each section of the venting channel, together with a replaceable structure which advantageously does not require subsequent cleaning of the pen, as ink is changed.

Accordingly, it is a primary object of the present invention to teach a manner of designing a technical drafting pen which will minimize and control ink droplet formation at the writing tip. Further objects, features, and advantages of the present invention will become more apparent with reference to the following description of preferred embodiments, wherein references are made to the attached drawings.

DESCRIPTION OF THE PREFERRED EMBODIMENTS

Figure 1:
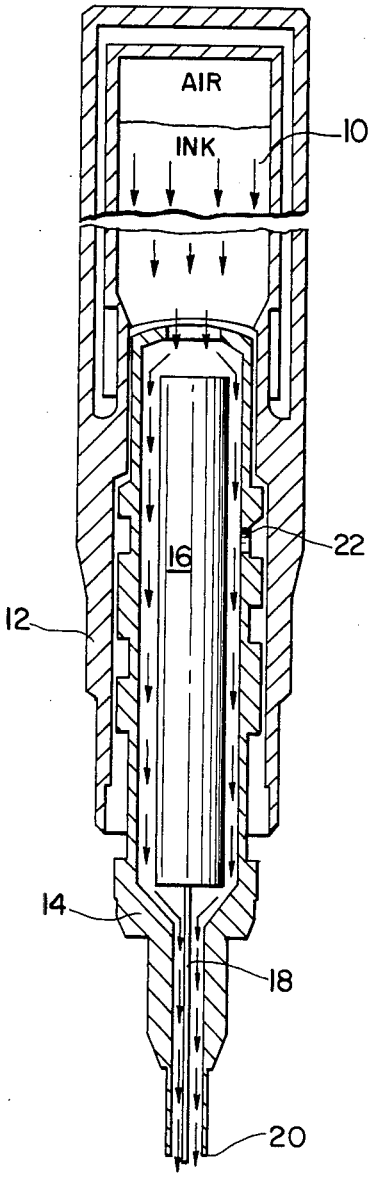
FIG. 1 is an elevation, partially in section, showing a conventional stylographic writing pen which embodies an ink reservoir, a tubular writing tip with a weight cleaning wire therein, as well as a vent hole which extends from the reservoir to, ultimately, an ambient air level.

Technical or stylographic drafting pens, conventionally utilize a stylographic writing tube which is supported within a housing, wherein a cleansing wire is attached to a weight so as to assist flow to the writing tip. Of course, this category of device is well known in the prior art, and is both illustrated in the above-discussed prior art references, and also known, schematically, in FIG. 1. The basic device, as depicted in FIG. 1, consists of an ink reservoir, 10, which contains some quantity of ink and air, as illustrated, a pen body, 12, with a nib, 14, is fitted at its front end with a writing tube, 20. A conventional weight, 16, is also illustrated, with its projecting cleansing wire, 18, being conventionally employed so that longitudinal travel of the weight, 16, will be limited, typically, by a retaining collar or shoulder contact. Such a contact ensures that even in the extreme forward position, the wire, 18, will project beyond the axial bore of the tubular writing point, 20 by a controlled amount. It is well known that such pens are gravityfed instruments, and are substantially affected by ambient temperature and pressure changes. Accordingly, it is conventional in such a category of device to include a venting channel, which communicates ambient air into the interior of the ink reservoir, as through a venting hole, 22, as illustrated in FIG. 1.

Although venting channels are normally an integral part of the surface of the nib, they can also be located on the interior of the pen body. See, and compare, the functionally equivalent designs of the embodiments in FIG. 2, FIG. 5 and FIG. 6. It is well known that, regardless of their location and configuration, venting channels provide two basic functions for the pen; without which the pen could not operate. The first function is to provide a path for air into the interior of the pen, so as to replace ink that has left the pen through the tubular writing tip 20 in the process of drawing lines. Hence, the hydrodynamic equilibrium of the pen will not be destroyed by the creation of low absolute pressures inside the pen reservoir, which, in turn, would prohibit further ink from coming out of writing tip 20. The second function served by any venting channel is to provide a pressure and temperature equalization chamber. As ambient pressure and temperature changes, the air inside the pen will expand and contract and, accordingly, force ink out or pull air into the venting channel. These two functions are most undesirable and are avoided by the use of the venting channel, which conventionally has correspondingly larger dimensions than the writing tube, and thereby provides a parallel, and low resistance path for ink to travel.

Since normal temperature and pressure variations require a substantial volume for this equalization function in the venting channel, pen manufacturers typically utilize a very long venting channel, either of a spiral or labyrinth configuration, and concentric about the axis of the pen. As such, the leading edge of the thread or column of ink in the venting channel can be found anywhere along the length of the venting channel, when a given pen is randomly uncapped just prior to a random use. It is also well known that the ink flow obtained in a particular pen is not uniform and can be heavy or slight; a situation annoying to draftsmen to say the least. The present invention substantially departs from such prior design attitudes, by a novel appreciation of how capillary and gravitational forces operate inside a pen. This novel approach provides the basis for the improved venting channel construction taught herein.

The quite detailed example of technical pen total pressure modeling which follows hereinafter, is primarily grounded upon a novel application of the LaPlace equation. The LaPlace equation shows that a pressure exists at a curved liquid vapor interface which is directly proportional to the surface tension of the liquid and inversely proportional to the mean radius of curvature of the interface. Since the curvature at an interface of a liquid in a capillary channel is known to be dependent on the dimensions of the channel and the contact angle of the liquid on the capillary wall surfaces, capillary pressures for inks in venting channels can be calculated for those parameters. Since it is also well known that liquids transmit pressure, it can readily be seen that the shape of a venting channel will have a direct effect on the pressure of the ink at the writing tube. It is also well known that pressure in a liquid is directly proportional to the static head of the liquid and thus for a venting channel that is uniform in cross-section the effect of the amount of ink in the venting channel on the pressure of the ink is proportional to the total height of ink up to the curved liquid vapor interface. The laminar flow of liquids, in narrow cylindrical tubes (such as the writing tube of a pen), is given by Poiseuille's equation which states that the flow is proportional to the pressure differences, as well as being dependnet upon the geometry of the tube. These considerations are taught herein to clearly indicate that differences in ink flow in a pen are directly traceable to variations in the height of the ink meniscus in the venting channel. The schematic showings of such a variation are graphically represented, in a layout fashion, at FIGS. 3 and 4. Exact values for this excursion need to be calculated as noted above, for the different parameters above-identified. Hereinafter, representative numerical examples are given, in further illustration.

A further difficulty related to a venting channel design is its typical location. As is well known, technical drafting pens are manufactured to operate with India inks which are carbon black dispersions in an aqueous medium. Since these inks will dry inside the pen after repated uncappings and periods of storage, the draftsman is confronted with the substantial problem of cleaning a dirty pen. In order to assure proper function of the pen, the venting channel should also be cleaned. It can easily be seen that any cleaning solution chemical residue left on the walls of the venting channel will affect the contact angle of the ink and, thus, the capillary pressure at the tip of the pen. In order to effectively clean conventional drafting pens, the cumbersome and messy procedure of disassembly of ink covered parts is necessary.

In order to overcome the problems of venting channel capillary pressures, according to the present invention, one needs to construct venting channels that vary one or more of their cross-sectional dimensions as a function of the distance from that section to the venting hole (into the reservoir). In this manner, increases in gravitational pressures can be offset by increases in capillary pressures in the case of venting channels leading upwardly from a vent hole to the ink reservoir. For venting channels leading downwardly (i.e., in a direction towards the writing tip) the consequent decreases in gravitational pressure can be offset by decreases in capillary pressure, as ink advances into the venting channel.

Figure 2:
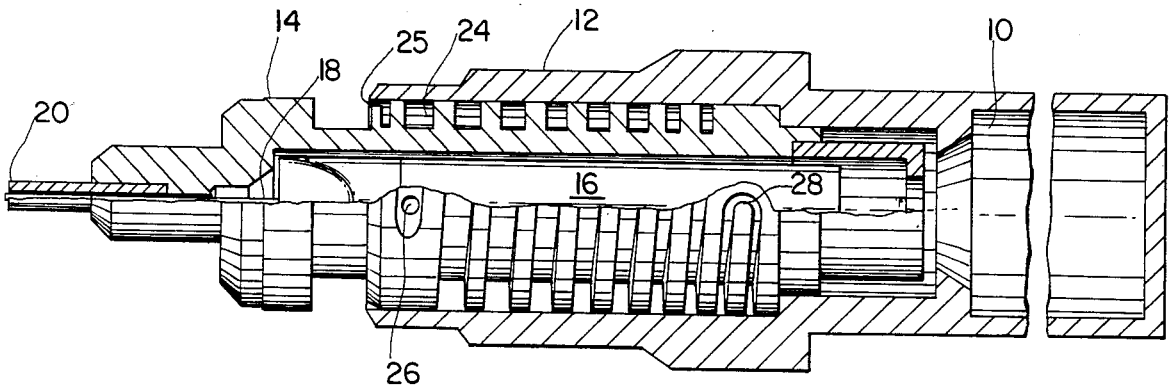
FIG. 2 is a side elevation, partially in section, showing one embodiment of the present invention, of the double-spiral venting channel type, which is made according to the teachings of this present invention.
Figure 3:
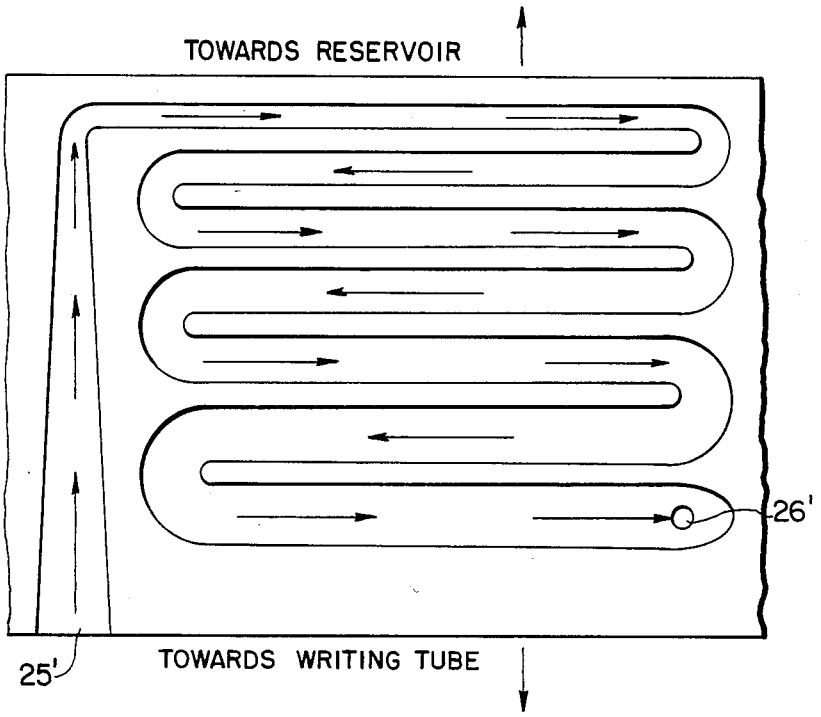
FIG. 3 is a schematic view of a second embodiment, wherein a single spiral venting channel construction is employed.
Figure 4:
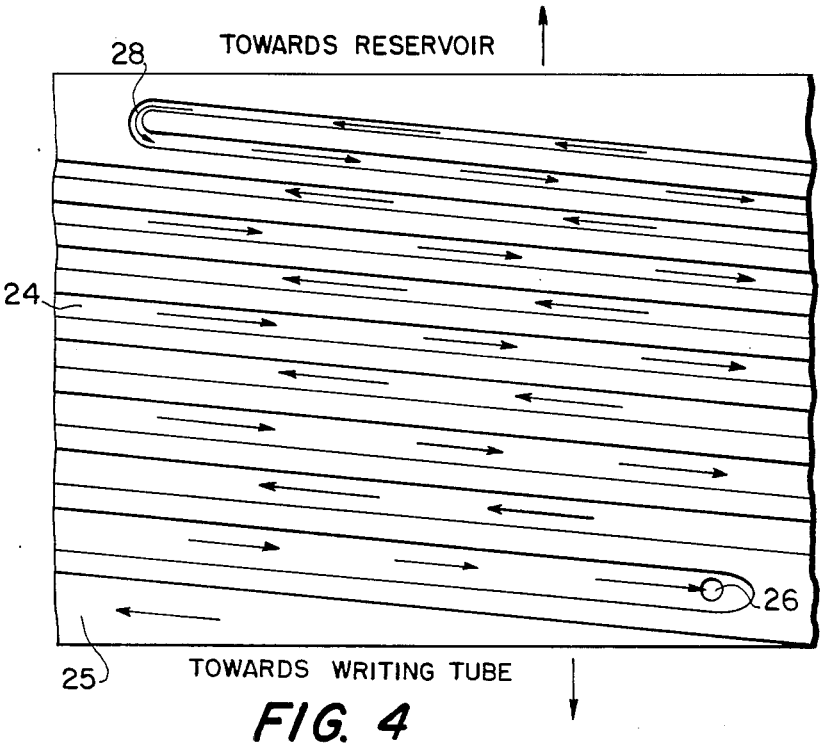
FIG. 4 is a schematic view showing the variation in a double-spiral cross-sectional area, and particularly as according to FIG. 2.

A first embodiment conforming to the foregoing requirements is shown in FIG. 2 wherein certain conventional parts of the improved device are directly equivalent to the exemplary prior art version of FIG. 1 and, hence, certain same reference numbers are used, for continuity. The FIG. 2 pen is provided with a double threaded left handed spiral channel 24, of varying pitch, communicating with ambient air as at 25 and communicating with the ink reservoir nib at venting hole 26. Each of the spiral threads connect together at their uppermost point, 28, and, as shown, the lowermost point of one spiral terminates to the open air, at 25. As can also be seen, the vertical dimension of the rectangular section of channel 24 decreases uniformly as sections further away from the writing tube are chosen. The same vertical dimension then increases again as channel 24 folds back on itself at point 28 and heads in the direction of the writing tip 20. The transverse dimension of the section of channel 24 could also have been made to vary in this manner and both vertical and transverse dimensions could also have been made to vary simultaneously. Single spiral venting channels and labyrinth type venting channels can also be similarly designed in such a way that the pressure variations due to varying gravitational pressure head are balanced and offset by capillary pressures, as illustrated in FIGS. 3 and 4. The unique principle in both cases being that capillary forces are controlled by changing venting channel section dimensions as a function of the distance of the section from the venting hole. This function, as noted above, is essentially a total pressure balance between all forces acting upon the ink which forms at the writing tip, 20, and critically requires a recognition that the LaPlace equation can be used to exactly define a vent channel cross-section as a function of height, above the vent hole, 26, in FIGS. 2–4.

Before giving further examples, test results and particulars on the currently preferred embodiment of FIG. 7 (as required by 35 U.S.C. §112, first paragraph), a brief review of the second and third embodiments, shown respectively at FIGS. 5 and 6, will be given, since they are both functionally equivalent in venting performance to FIG. 2.

Figure 5:
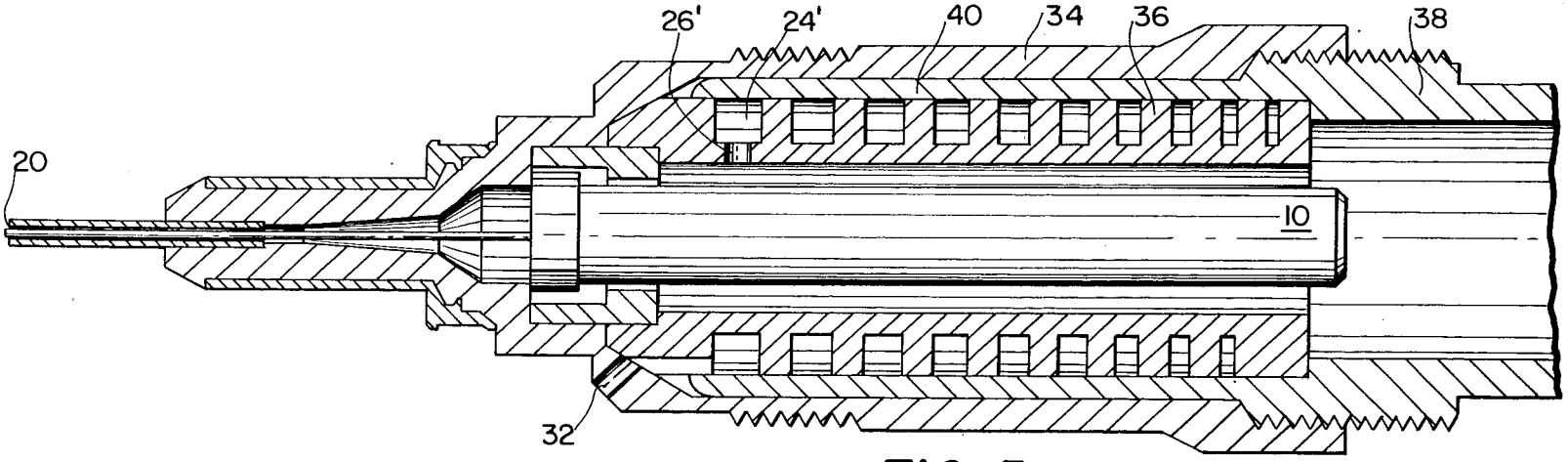
FIG. 5 is a longitudinal section of a third embodiment of the invention, and one that is substantially equivalent to FIG. 2, though with the venting channel system being defined against the interior surface of a replaceable cartridge, which itself engages the pen body.
Figure 6:
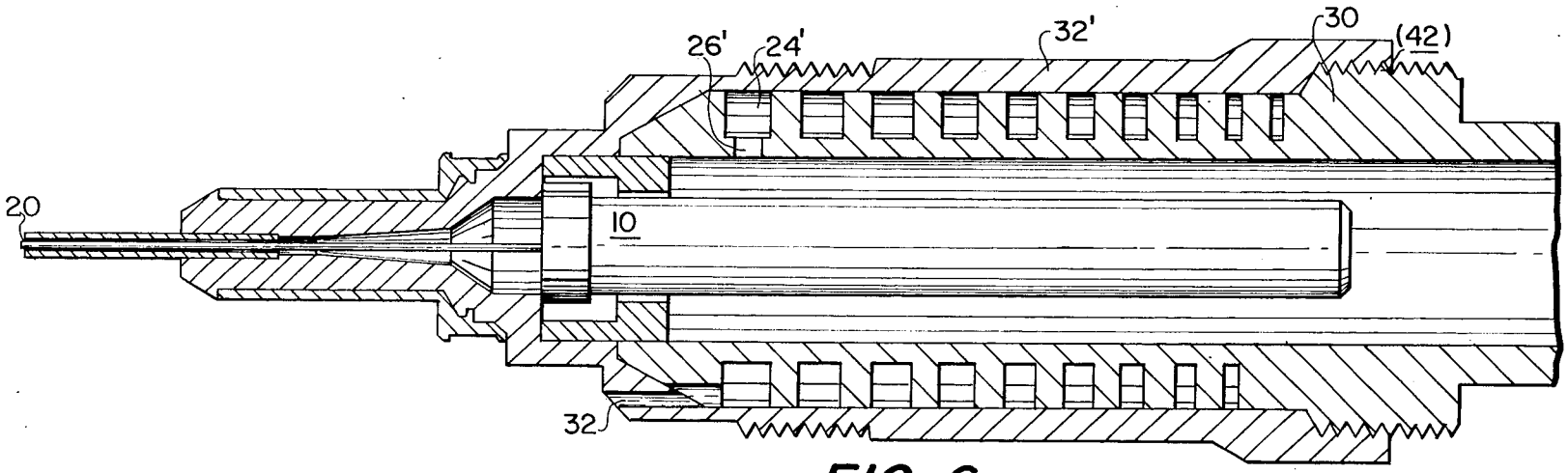
FIG. 6 is a fourth embodiment of the invention, with another system substantially similar to FIG. 2, though with the venting system being defined about the exterior surface of a replaceable cartridge element, which can be removably supported within a writing nib.

A unique and novel solution to the problem of having to clean the unique venting channel construction taught herein is one that simply obviates that procedure, in that the vent channel is incorporated in the cartridge of the pen, as illustrated in FIGS. 5 and 6. Primed reference numbers are employed, where appropriate, to facilitate an understanding of operation to the first embodiment of FIG. 2. By including the vent channel 24' as an integral part of a cartridge, e.g., as a prefilled cartridge, 38, which is illustrated in FIG. 5, the cleaning procedure becomes unnecessary. Upon removing cartridge, 38, the whole cartridge (including the housing, 40, around the venting channel) would then be discarded and replaced, in nib, 34, by a fresh clean empty cartridge or prefilled cartridge equipped with its own clean venting channel. As previously noted, the improved venting channel 24' can be the double spiral type or any other form, as shown schematically in FIGS. 3 and 4. The vent can have walls, 36, which are an integral part of the cartridge, 38, or be located on the exterior of a cartridge, 30, as in FIG. 6. As such, no cleaning of the venting channel is required. According to both the FIGS. 5 and 6 embodiments, the cartridges 38, 30, are respectively held in place by a threaded engagement, as at 42, with a pen body cover, 34 and 32', respectively.

According to the modification illustrated in FIG. 6, the outwardly open vent channel on the inward end of cartridge, 30, is rested into engagement with the interior of the wall of nib, 34'. According to both modifications, the improved venting channel 24' communicates with ambient air via venting port 32, and this venting port 32 is located at a distance quite proximate the writing tip, 20, as is vent hole 26'.

Figure 7:
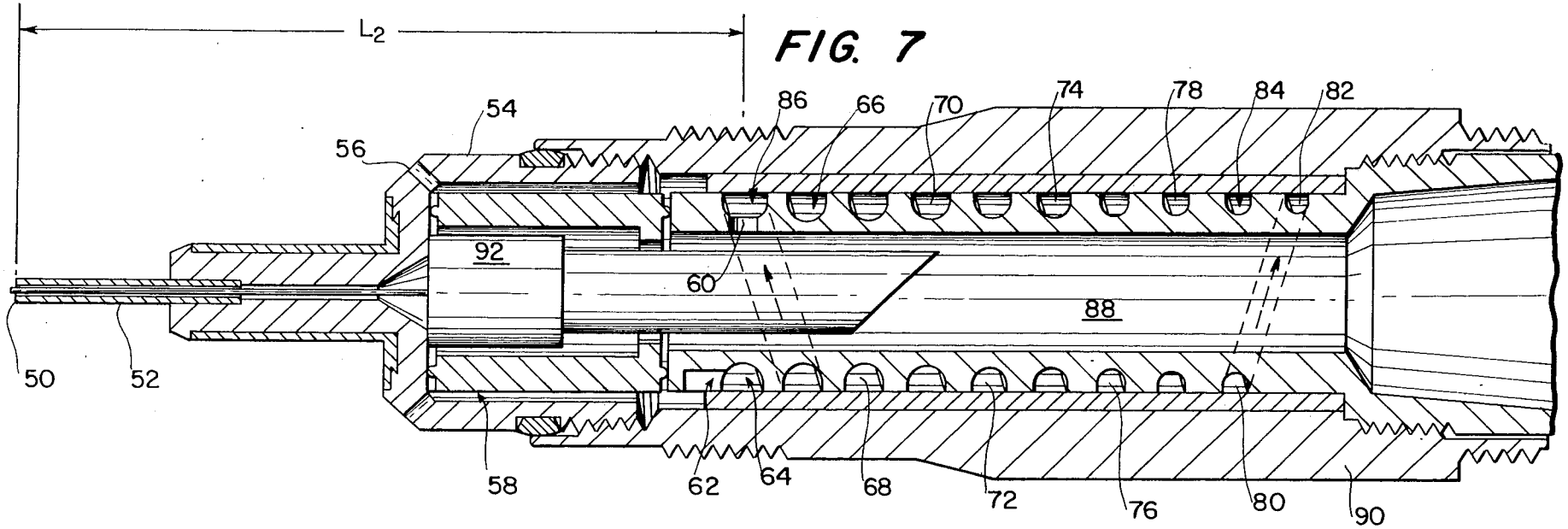
FIGS. 7 and 8 are a fifth and preferred embodiment of the invention, also of the double-spiral venting type.
Figure 8:
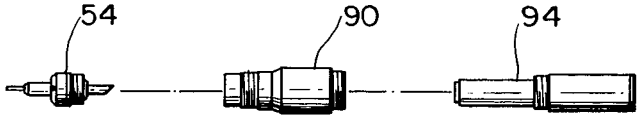

The preferred embodiment of the invention is shown in FIG. 7, and is considered the best mode known to applicants, at the present time, for practicing the invention taught herein. Accordingly, and pursuant to 35 U.S.C. §112, first paragraph, applicants will now describe the preferred embodiment, and thereafter further give examples, both numerical and by way of tests, which bear out the theory and teachings of the present invention.

The preferred embodiment of FIG. 7 functions in a manner analogous to the double spiral example, for example, of FIG. 2. A writing tube, 52, includes a weight and wire, 92, which extends to just proximate the writing tube point, 50. A housing, 90, is sealingly and releasably connected to the nib, 54, as by the threaded illustration of FIG. 7. An ink reservoir, 88, is communicated to the writing tube point, 50, as by the indicated piercing element, extending from and surrounded by, the removable weight, 92. For purposes of understanding the present improvements, the first thing to note is that the vent hole, which has been defined as the intercommunication between a venting channel and an ink reservoir, (and identified at 60), is shown a distance $L_2$ above a datum which is chosen as the tip, 50, of the writing tube. Ink within the reservoir, 88, can expand into a vent channel system which, in this preferred embodiment of FIG. 7, is of the double spiral type, as hereinbefore discussed with respect to FIGS. 2 and 4, wich each spiral interconnected, as between the sections identified at 82, and 84. To further present the travel of air from a venting port, 56, doted lines are used. Ambient air enters port, 56, then travels into nib annulus, 58, and thereafter into connecting annulus, 62, and directly into the beginning cross-sectional port of the venting channel system, which has been conveniently identified at FIG. 7 at 64. FIG. 7 is drawn essentially to a scale, wherein the horizontal width of semi-circular depression, 64, is 0.13 centimeters, and the vertical height is 0.09 centimeters. The radius portion of this semi-circular depression 64 is 0.065 centimeters.

Similarly, and for reasons discussed hereinafter, the bottom end of the second spiral (cross-section 86), is similarly dimensioned, and communicates to the ink reservoir, 88, through a vent hole of a 0.08 cm. diameter.

Again following the travel of air from aperture, 56, and as shown by the arrows and dotted section of FIG. 7, the semi-circular cross-section at 64 connects in a helical manner, in series, to cross-sections 66,68, 70, 72, 74, 76, 78, 80, and 82. As is apparent from the scaled illustration of FIG. 7, aperture, 82, is a certain distance above vent hole, 60, and this distance will hereinafter be referred to as the variable $h_3$. Again, for reference purpose, the horizontal dimension of the semi-circular section, 82, is 0.07 centimeters, and the vertical dimension therefor is 0.060 centimeters. The cross-section 82 is also located an $h_3$ value of 1.65 centimeters away, in an axial direction, from vent, 60. The indicated dimension $L_2$, which is the distance of the vent hole, 60, above the datum at the pen tip, 50, is 2.25 centimeters (0.86 inches). It should also be further noted that the aperture to ambient, 56, is located quite proximate the pen point, with the preferred embodiment FIG. 7 having the aperture, 56, approximately 1.2 centimeters from the pen tip, 50.

The uppermost or narrower section of the first spiral, at 82, then interconnects with the second spiral, by any sort of axial interconnection to the cross-section 84, with such a connection being substantially identical to the interconnection shown at 28 in FIG. 2. The beginning of the second spiral, at 84, then proceeds downward, towards the writing tip, in a similar fashion, winding up at the cross-section proximate the vent hole, 60, which is identified in FIG. 7 as 86.

To now illustrate how the above-given values were derived for the structure of FIG. 7, and to further illustrate how one of ordinary skill in this art would be able to follow the clear teachings of the present invention and exactly derive any and all remaining dimensions for the preferred embodiment of FIG. 7, complete technical examples will now be given, both theoretical and numerical. Thereafter follows examples which illustrate actual test results upon the principles of the present invention.

A technical pen can be visualized as the juxtaposition of two mathematical pressure models, each of which comprises an enclosed ink reservoir which actually contains both some ink, and some air. Each model is also equipped with a capillary, i.e., the first model includes a writing tube, and the second model includes a venting channel. The present invention essentially requires that the *total* pressure, of any given (and ever-changing) venting channel ink/air interface, be equilibriated to a constant; so that an ink droplet will always form, at the end of the writing tube, in response to the same driving pressure force, regardless of ink travel into the venting channel.

The first model to consider is the writing model which is shown in FIG. 9:

The LaPlace equation states that for any air/liquid interface the net pressure existing at the curved liquid air interface is:

$$P = \frac{2\gamma}{r_{m2}}$$

where $\gamma$ is the surface tension (dyne/cm.) of the liquid, and $r_m$ is the mean radius of curvature of the interface (cm.)

With reference to this first model, we may adopt the convention that pressures directed down are + (positive) and those directed up are − (negative). Hence, a further pressure analysis at the interface gives:

$$\text{up} - P_o, \frac{2\gamma}{r_{m2}}$$

$$\text{down} - \rho g(h_1 + L_2), P_1$$

where $P_o$ is atmospheric pressure (dyne/cm$^2$)

$P_1$ is pressure in the air in the pen (dyne/cm$^2$)

$\rho$ is the density of ink (g/cm$^3$) and g is the acceleration of gravity (cm/sec$^2$)

For equilibrium at the interface between the ink drop ($r_{m2}$) and the air ($P_o$) all pressures acting must sum to 0

$$\therefore \rho g(L_2 + h_1) + P_1 - \frac{2\gamma}{r_{m2}} - P_o = 0 \qquad \text{Eq. 1}$$

The point size radius ($r_2$) sets a limit to maximum pressure that the point can sustain and imposes a condition for equilibrium. With the ink flat at the writing face of the point, $r_{m2} = \infty$. As a meniscus builds, $r_{m2}$ decreases to a minimum given by $r_2$ and then increases again to a maximum given by some function of $r_2$ and $\gamma$. Hence, $$\frac{1}{r_{m2}}$$

varies smoothly from 0 at $Z=0$, to a maximum at $Z=r_2$, and then decreases down as Z approaches $2r_2$. A condition for hydrostatic equilibrium is, therefore, that $$Z \leqq r_2 \text{ and } r_{m2} \leqq r_2$$

where $$r_{m2} = \frac{1}{2}\left(\frac{r_2^2}{Z} + Z\right)$$

as illustrated, in FIG. 10:

Now turning to the venting channel, or second model, we may also do a pressure analysis of the air/ink interface which exists whenever ink is forced into the venting channel, because of pressure increases upon the ink in the reservoir ($P_1$). The second model is also grounded upon an application of the LaPlace equation to the venting channel geometry, and since a venting channel is a capillary system, we also include the known parameter of a contact angle ($\theta$), which is the wetting angle between a given drop of ink (surrounded by saturated vapor), and a given plastic substrate, i.e., $\theta=0$ for a total wetting. The second model is illustrated in FIG. 11, and a detail view of the contact angle ($\theta$) is illustrated in FIG. 12.

This second model, or the venting model, has a venting capillary which will initially allow expanding ink to either go up, or down. Looking at one going up, and including $\theta$, the contact angle, we have a LaPlace pressure balance at the air/ink meniscus (at $r_{m2}$) which is upwards directed and wherein $$P = \frac{2\gamma\cos\theta}{r_{m3}}$$

Also, upwardly directed are the indicated pressures $P_1$ and $\rho gh_1$, dur to the ink reservoir. The countering, or downwardly directed pressures, within the capillary, are $\rho gh_3$ and $P_o$. Accordingly, and as done hereinbefore with respect to the writing tube model, an equilibrium balance requires $$\rho g(h_3 - h_1) + P_o - P_1 - \frac{2\gamma\cos\theta}{r_{m3}} = 0 \quad \text{(Eq. 2)}$$

Combining both models we have a model for a complete pen where both Eq. 1 and Eq. 2 apply. An illustration of both models is provided in FIG. 13.

$$\rho g(L_2 + h_1) + P_1 - \frac{2\gamma}{r_{m2}} - P_o = 0 \quad \text{(Eq. 1)}$$

$$\rho g(h_3 - h_1) + P_o - P_1 - \frac{2\gamma\cos\theta}{r_{m3}} = 0 \quad \text{(Eq. 2)}$$

ADDING Eq. 1 to Eq. 2 WE GET $$\frac{2\gamma}{r_{m2}} = \rho g(L_2 + h_3) - \frac{2\gamma\cos\theta}{r_{m3}} \quad \text{(Eq. 3)}$$

Equation 3 allows us to see the requirements for equilibrium clearly. As $h_3$ and $r_{m3}$ increases for fixed values of $L_2$, $\rho$, $\gamma$, and $\theta$, $r_{m2}$ must decrease. $r_{m2}$ cannot, however, get smaller than the radius of the tip of the drafting point. Drops will form and break off until equilibrium is obtained.

We can also see from Eq. 3 how $r_{m3}$ must get smaller for increasing values of $h_3$, if $$\frac{2\gamma}{r_{m2}}$$

is to remain constant. Hence, the present invention critically teaches how to select values of $r_{m3}$ and $L_2$ so that $$\frac{2\gamma}{r_{m2}}$$

is held to values that are desirable.

Moreover, the present teachings avoid the prior art trial and error approach in pen channel geometry design, since applicants here, for the first time, specifically teach a technical drafting pen total pressure analysis approach which not only is surprisingly accurate, but very easy to apply. The present invention also has pointed to certain critical dimensions which were practically totally unrecognized, and dimensional relations which can dominate to create a well-behaved pen functioning.

Before a number of laboratory test examples, according to the present invention, are detailed, applicants will now illustrate how equation 3, above, was analytically used to define some surprising parameters which, in turn, were then used to construct the preferred embodiments taught herein, and particularly the double-spiral embodiment illustrated at FIG. 2, and the preferred double-spiral embodiment illustrated at FIG. 7.

EXAMPLE I

Equation 3 governs, as follows:

$$\rho g(L_2 + h_3) - \frac{2\gamma\cos\theta}{r_{m3}} = \frac{2\gamma}{r_{m2}}$$

If we substitute values for the parameters, wherein $\gamma = 40$ dyne/cm
$L_2 = 2$ cm.
$h_3 = 0, 1.5$ cm.
$\theta = 20°$
$r_{m3} = 0.05$ cm.
$\rho = 1.05$ g/cm$^3$ $$2060 - 1504 = \frac{2\gamma}{r_{m2}} = 556 \text{ dyne/cm}$$

$$r_{m2} = .144 \text{ cm.}$$

This value for $r_{m2}$ must remain constant, if no drops are to form when, due to air expansion in the reservoir, the ink advances into the vent channel to some new value of $h_3$, e.g., 1.5 cm; then a value for $r_{m3}$ can be determined so that there will be no change in $r_{m2}$:

$$\rho g(L_2 + h_3) - \frac{2\gamma\cos\theta}{r_{m3}} = \frac{2\gamma}{r_{m2}}$$

Let $h_3 = 1.5$ cm:

$$(1.05)(981)(2 + 1.5) - \frac{(2)(40)(.94)}{r_{m3}} = \frac{(2)(40)}{.144}$$

$$r_{m3} = .025 \text{ cm.}$$

The pressure and quantity of ink at the tubular writing point ($r_{m2}$) is the same for the two values of $h_3$, so long as $r_{m3}$ is made to change to equally offset the increased static pressure ($h_3$ increases) by increasing capillary pressures (at the new $h_3$ level).

If the venting channel is round with a radius r, then $r_{m3} = r$.

If the channel is rectangular with dimensions $2a$ and $2b$, a good approximation is given by $$\frac{1}{r_{m3}} = \frac{1}{a} + \frac{1}{b}$$

EXAMPLE II

To further illustrate the essential underlying design criteria of balancing total pressures by the Eq. 3 taught herein, applicants further parametrized the relationships. This example is quite similar to Example I, however, the design approach herein determined how a double-spiral embodiment could be successfully sized to practice the essential principles taught by the present invention.

If we again begin with the total pressure balance equation (Eq. 3), or $$\frac{2\gamma}{r_{m3}} = \rho g(L_2 + h_3) - \frac{2\gamma\cos\theta}{r_{m3}},$$

we may first focus upon a desired (and stable) ink droplet extension (Z) downward from the writing tube orifice.

If we choose a meniscus at the tip of a pen having a diameter of 0.2 cm. ($r_2=0.1$ cm) where $Z=0.25\ r_2$, and is as illustrated hereinabove, then $$r_{m2} = \tfrac{1}{2}\left(\frac{r_2^2}{Z} + Z\right).$$

If we substitute desired values, $$r_{m2} = \tfrac{1}{2}\left(\frac{r_2^2}{.25r_2} + .25r_2\right)$$

$$r_{m2} = .2125 \text{ cm.}$$

Hence, $$\frac{2\gamma}{r_{m2}} = \frac{2.40}{.2125} = 376 \text{ dyne/cm}^2$$

for a typical India ink value of $\gamma=40$ dyne/cm.

Now, we may desire certain values for $L_2$, defined as the (fixed) height of the vent hole, which communicates the vent channel to the ink reservoir, above a datum chosen at the tip of the writing tube, according to an equilibrium balance of;

$$376 = \rho g(L_2 - h_3) - \frac{2\gamma\cos\theta}{r_{m3}}$$

From Example I it was observed that when no ink was in the venting channel ($h_3=0$) the value of $r_{m3}$ for that point of the venting channel was 0.025, and further that an expectable variation was $0.025 \text{ cm} \leqq r_{m3} \leqq 0.060$ cm.

Therefore, it was realized that an $h_3=0$ situation could be advantageously "stepped", provided there was a matching of a given value of $L_2$ to the progressive change of $r_{m3}$, in a positive or negative sense. In other words, if $h_3=0$ cm and $r_{m3}=0.025$ cm;

$$376=(1.05\cdot981\cdot L_2)-(2\cdot40\cdot1)(0.025)^{-1}$$

and $L_2$ of 3.47 cm. is required.

Now, if we desire to step to a new vent-hole height ($L_2$), wherein the absence of ink in the vent channel corresponds to the maximum value of $r_{m3}$ ($r_{m3}=0.060$ cm) we can alternatively solve the equilibrium pressure state, of 376 dyne/cm$^2$, as follows:

Let $h_3=0$ $r_{m3}=0.060$ cm.

$$376=1.05\cdot981\cdot L_2-2\cdot40.0\cdot060^{-1}$$

and now $L_2$ of 1.66 cm. is then required.

Applicants, therefore, have shown that the present invention can also be uniquely practiced by a double spiral embodiment, as in FIGS. 2 and 7, since the total pressure balance illustrated in Example II obtains both for an $L_2$ of 1.66 cm (with an $h_3$ increase from 0 to 1.81 cm as $r_{m3}$ *decreases* from 0.060 cm to 0.025 cm) and for an $L_2$ of 3.47 cm (with an $h_3$ decrease from 0 to $-1.81$ cm as $r_{m3}$ *increases* from 0.025 cm to 0.060 cm).

To summarize, Example II further proves the controlling relationships which define the changing capillary cross-sectional area ($r_{m3}$) of the venting channel, as a function of the distance ($h_3$) above (or below) a vent hole height ($L_2$). For the upward spiral portion of a double spiral, as in FIG. 7, an $L_2$ of 1.66 cm equals the distance between the tip of the writing tube and the transverse passage connecting ink reservoir to the beginning of the first vent channel spiral. For the downward spiral portion, i.e., when ink has filled the entire first spiral (to an $h_3$ equal to $3.47-1.66$, or 1.81 cm) the pressure balance during any further, downward travel will be effectively referenced to an $L_2$ of 3.47 cm.

It cannot be overemphasized that the value of $r_{m3}$, i.e., the capillary cross-sectional view of any given point in the vent channel system, is therefore uniquely defined and controlled by the governing total balance equation discovered by the applicants herein. The term "spiral" for example is merely a convenient appelation for a specific teaching on maintaining a total pressure balance at the tip of a technical drafting pen; and a teaching which devolves to $r_{m3}$ being a defined function of $h_3$, for a given set of initially and easily chosen pen and ink parameters.

As previously noted, $r_{m3}$ was defined as the "mean radius of curvature", and is physically the radius of curvature of the liquid meniscus formed at a given height in the vent channel. For a simple round capillary shape at a venting channel cross-section, and exactly equal that radius for a total wetting; i.e., $\cos\theta=1$, this $r_{m3}$ will follow the geometric radius at the section. This is again mentioned to emphasize that, due to the capillary effects being controlled herein, the geometric shape at each vent channel cross-section is in fact the critical parameter; and not simply the "net" cross-sectional area at any given vent channel cross-section. Our invention may, of course, be practice with cross-sections of other than pure circular form, and the preferred embodiment of FIG. 7 manifestly illustrates a semi-circular depression. In fact, square, rectangular and trapezoidal cross-sections have been investigated, and $r_{m3}$ values calculated, however any sharp-cornered cross-sections could tend to also involve corner capillary effects which would conduct ink away from the reservoir.

It also cannot be overemphasized that the vertical location of the interconnection between ink reservoir and beginning of the venting channel, with respect to the bottom of the writing tube, i.e., that dimension defined herein as $L_2$, is a most surprising variable, with its *value* having a very dominant effect, together with subsequent vent-channel shaping, upon well-behaved writing; a pen that is hydrostatically stable insofar as no dripping, and less blobbing, are experienced.

A further, and quite unexpected result from choosing $L_2$ to be of an appropriately small value, was that smaller cleaning wires within the writing tube, or stylus, could now be employed—with blacker ink lines, faster writing speeds, and less dependence of the width upon writing speed being the happy result.

To further illustrate that applicants herein have also, and accurately, been the first to identify the importance of choosing a particular $L_2$, as defined herein, for optimum technical pen writing performance, a further comparative test was conducted, wherein it was sought to measure the relative performance of identical pairs of technical writing pens; wherein in all cases a value of $H_3=0$ was created; so that no additional (or extraneous) effects would be introduced by total pressure variations, at the writing tip, which were arising from any ink movements into the venting channel. This is a valid test for applicants' teachings herein, since an $h_3=0$ situataion is an initial condition which often occurs, and is clearly accounted for within the present teaching. Hence, the following example, Example III, is offered to give further, and empirical support to the validity of applicants' novel approach to a stylographic pen venting channel design, as succinctly embodied by the controlling relationships of Equation 3, since the following example illustrates an initial, if seldom, condition wherein no ink at all has moved into the venting channel ($H_3=0$), and on a comparative basis illustrates that applicants' teaching for a particualr location of $L_2$, is an unobvious design consideration as part of the invention taught herein.

EXAMPLE III

Procedure

Several Koh-I-Noor Rapidometric® Series 3095 pens (by Koh-I-Noor Rapidograph, Inc., Bloomsbury, N.J.), of sizes 200SS, 1.00SS, 0.35J and 0.18T, were modified in that existing venting holes were epoxied shut and new venting holes were drilled having smaller diameters of 0.30, 0.35, 0.40, and 0.47" at venting hole heights of 0.600 and 0.860". Standard weight wires for these pens were machined to decrease their outer diameter from 0.156 to 0.117 and 0.127". Various combinations of test pens were assembled and compared to standard control pens for maximum writing speed, line width and ink flow on the Test 04 Machine running at 1, 5, 10–50 and 1 cm/sec where a maximum writing speed of 50 cm/sec was achieved. For pens not able to achieve 50 cm/sec, the writing speed of 1 cm/sec was repeated as soon as skippage was observed. All testing was performed at 87°, 14 grams, with 3080 ink on Rapidraw® drafting film, which is also a product of Koh-I-Noor Rapidograph, Inc., of Bloomsbury, N.J.

In addition, various combinations of test pens were assembled and compared to standard control pens on a Minitek model P.S.U., a standard writing or pen test machine of Austrian manufacture. Ten each pens were suspended vertically above Rapidraw® for periods ranging from 12 minutes to 15 seconds and then made to write 5 cm line sections at writing speeds ranging from 0.007 to 0.333 cm/sec. The resultant line sections were measured at the start to determine the size of the blob at the beginning of the line as well as at 2 and 4 cm to determine slow speed line width. This test permits an evaluation of ink line spreading at very slow speeds as well as open pen time as affected by venting geometry.

Results

The test is summarized, as follows:

(1) Comparing Series 3095 Rapidometric 2.00 mm. SS (stainless steel point) pens, equipped with venting holes of 0.030, 0.035 and 0.040" at a height of 0.600" and equipped with 0.006" wires, show slow speed line width averaged at 1 and 5 cm/sec is slightly wider for the test pens than the control. While the control pens were able to achieve a maximum writing speed of 7 cm/sec, the test pens typically had maximum writing speeds ranging from 33 to 36 cm/sec. Ink flow was 5 times heavier for the test pens resulting in much blacker lines.

(2) Comparing a similar range of venting hole diameters in Rapidometric Series 3095 1.00 mm. SS pens equipped with 0.006" wires at a height of 0.600" shows also that slow speed line width is slightly larger for the test pens. Ink flow again was seen to be approximately 4 times heavier while maximum writing speed was seen to be in excess of 50 cm/sec compared to the 15 cm/sec of the control pens.

(3) Testing 0.35 Rapidometric Series 3095 jewel points equipped with 0.003" wires and venting holes measuring 0.30, 0.35 and 0.40", at 0.600" shows no significant difference to control pens at slow writing speeds. Ink flow was, however, substantially affected in that test pens were measured to have ink flow rate of 2.1 to 2.2 mg/m compared to the 1.3 mg/m for the control pens. Again maximum writing speed was seen to be greater than 50 cm/sec compared to a 32 cm/sec of the control pens.

In a separate test of 0.35 jewel pens with wire diameters of 0.006" with a venting hole of 0.035" at 0.600" it was seen that there was no difference in line width for these pens and standard control pens. Nor were any substantial differences seen for ink flow and maximum writing speed.

(4) Comparing Rapidometric Series 3095 0.18 tungsten pens equipped with 0.035" venting holes at 0.600" running without a wire along with Rapidometric 0.18 tungsten pens with 0.040" venting hole at 0.600" and equipped with a 0.003" wire, with standard production control pens show that the widest lines (0.235 mm) were obtained for test pens equipped without a wire. In terms of average line width, no substantial differences were seen for these 3 groups of pens. Ink flow rates, however, show differences in that "no-wire" pens were measured to have 0.90 mg/m, low venting hole pens 0.48 mg/m and standard production control pens 0.31 mg/m with respective maximum writing speeds of 45, 30 and 24 cm/sec.

(5) Measuring *line widths* (at very *slow* speeds) obtained on the Minitek showed that:

(a) no substantial differences were observed for 0.18 tungsten and 0.35 jewel pens regardless of venting hole geometry or cleaning wire diameter.

(b) for 0.35 jewel pens equipped with 0.003" diameter wires (and smaller lower venting holes) narrower lines were obtained at very slow writing speeds compared with control pens. The tendency of pens equipped with *lower,* smaller venting holes to draw slightly narrower lines, and dry out more quickly, was observed.

(c) for 1.00SS low small venting hole pens equipped with small wires narrower lines were measured at slower writing speeds than for the control pens. Similar results were observed for 2.00 steel pens.

(6) In examining the data it was seen that test pens equipped with low and small venting holes tend to have less ink available at the point so that on touching down after periods of vertical suspension, less blobbing at the beginning of a line is observed. For the same reason, such pens tend to dry more quickly while being suspended vertically.

While various embodiments and explanations for the principles of the present invention have been detailed, it is our intention that the invention is to be solely defined by the scope of the appended claims.

We claim:

1. In a stylographic drafting pen of the type comprising a housing which surrounds an ink reservoir, a writing nib which communicates ink, in a longitudinal direction, from said reservoir to form a drop at the tip of a writing tube, and a venting channel which communicates, at a first end, with said ink reservoir through a vent hole and, at a second end, with ambient air, the improvement comprising:

(a) a venting channel which has a cross-sectional area variation from said first to said second end, as a function of longitudinal distance of a given vent cross-section, $h_3$, in elevation above said vent hole which is spaced a longitudinal distance $L_2$ above said tip (whereat $h_3=0$), wherein said vent cross-sectional variation is defined so that variations in the hydrostatic pressure, which is experienced at the pen tip, as a consequence of ink travel within the venting channel to a given value of $h_3$, are balanced and offset by variations in the capillary force which then acts upon the air/ink interface of a meniscus of ink formed as a result of the cross-sectional value of said vent cross-section which is defined at said given value of $h_3$, and (b) wherein, said venting channel improvement further comprises, for a given value of a preferred mean radius of curvature of a droplet at the pen point ($r_{m2}$), a given ink surface tension ($\gamma$) and density ($\rho$), a height of the vent hole above the tip of the writing pen ($L_2$), the gravity acceleration constant (g), a given contact angle ($\theta$) between said ink and the material defining the walls of said venting channel, a venting channel cross-sectional area variation which is a decreasing function as $h_3$ increases away from said tip, wherein at any $h_3$ the cross-section value will ensure that the mean radius of curvature of an ink meniscus ($r_{m3}$) at that $h_3$ is governed by the relationship, as follows:

$$\frac{2\gamma}{r_{m2}} = \rho g(L_2 + h_3) - \frac{2\gamma\cos\theta}{r_{m3}}$$

2. In a stylographic drafting pen, according to claim 1, the further improvement which comprises defining that total pressure, at the writing tip, which is to be balanced by variations of $h_3$ from $h_3=0$, by an allowable droplet extension (Z), measured down from said tip, and a mean radius of curvature for said drop ($r_{m2}$) by a relationship to the radius of said writing tube ($r_2$), which is, as follows:

$$r_{m2} = \frac{1}{2}\left(\frac{r_2^2}{Z} + Z\right)$$

wherein Z is less than or equal to $r_2$ and $r_{m2}$ is greater than or equal to $r_2$.

3. In a stylographic drafting pen according to claim 2, the further improvement which comprises defining said vent hole distance ($L_2$) as a function of an acceptable value for the mean radius of curvature of a droplet at said writing tip ($r_{m2}$), whereby, for a given ink having a surface tension ($\gamma$) and a density ($\rho$), where g is the acceleration due to gravity, said function is as follows:

$$L_2 = \frac{2\gamma}{\rho g r_{m2}}$$

4. In a stylographic drafting pen according to claim 1, the further improvement which comprises said first end of said venting channel communicating to said ink reservoir at a point which is proximate to the edge of said ink reservoir which is closest to said writing tip.

5. In a stylographic drafting pen according to claim 4, wherein said second end of said venting channel extends through said writing nib at a point proximate the tip of the writing tube.

6. In a stylographic drafting pen according to claim 1, the further improvement which comprises two spirals defining said venting channel, said spirals being interconnected at a point of smallest cross-section which is located farthest away from said vent hole, wherein the largest cross-sectional area of each spiral communicates, respectively, with said ink reservoir, at said first end, and with ambient air through a port, proximate said writing tube tip, at said second end of said venting channel.

7. A pressure balanced stylographic drafting pen of the type comprising a housing which surrounds an ink reservoir, a writing nib which communicates ink from said reservoir, in a longitudinal direction, to the tip of a writing tube, and a venting channel which communicates, at a first end, to an ink reservoir through a vent hole and, at a second end, to an ambient air port, which comprises:

(a) a venting channel which has a cross-sectional area variation as a function of the distance ($h_3$) of a given cross-section from said first end of the venting channel, wherein said cross-sectional area variation is a function of a mean radius of curvature ($r_{m3}$) for a meniscus of ink which forms at an ink air interface of an ink column at a given value of $h_3$; wherein (b) said vent hole, at the first end of said venting channel, is located a distance ($L_2$) from the tip of said writing tube and said vent hole is also proximate to the writing nib end of said ink reservoir; and (c) said venting channel extends longitudinally, for increasing values of $h_3$, in a double-spiral fashion, wherein said venting channel first end communicates with said vent hole, with an initial cross-sectional area thereat which then decreases in cross-sectional area as $h_3$ increases away from said writing tip, to a position on said housing whereat said venting channel returns in a second spiral, towards the second end of said venting channel, said second end communicating with said ambient air port and being proximate the writing tube of said pen, wherein said variations in vent channel cross-section enable hydrostatic pressure increases, as ink fills said venting channel, to be directly balanced and offset by a variable capillary force upon the ink/air interface at the meniscus of said ink column, with said capillary force being a direct function of $h_3$, (d) wherein the initial value for the venting channel cross-section of $h_3=0$ is defined by a relationship, for an ink having a given surface tension ($\gamma$), a given density ($\rho$), and a given wetting angle between said ink and the material of which the venting channel is constructed ($\theta$) so that a desired mean radius of curvature for an ink droplet at the writing tip ($r_{m2}$) will be maintained stable, and not break away, in response to increased values of hydrostatic pressure from increasing columns of ink within said venting channel according to a relationship where g is the acceleration due to gravity, as follows:

$$\frac{2\gamma}{r_{m3}} = \rho g(L_2 + h_3) - \frac{2\gamma\cos\theta}{r_{m3}}$$

8. A stylographic writing pen according to claim 7, wherein the value of $L_2$ is approximately between 1.00 centimeter and 3.00 centimeters, said ink is India ink with a surface tension ($\gamma$) of approximately 30 to 45 (dyne/centimeters) and a density ($\rho$) of 1.05 (grams per centimeter), and the initial total pressure at the tip is established with an $L_2$ wherein $r_{m2}$ is approximately equal to the radius of said tubular writing tip ($r_2$).

* * * * *